US005278539A

United States Patent [19]

Lauterbach et al.

[11] Patent Number: 5,278,539

[45] Date of Patent: Jan. 11, 1994

[54] ALERTING AND WARNING SYSTEM

[75] Inventors: Lyn Lauterbach, Hopatcong, N.J.; Laird H. Wise, Jr., Ellicott City, Md.

[73] Assignee: Bell Atlantic Network Services, Inc., Arlington, Va.

[21] Appl. No.: 834,050

[22] Filed: Feb. 11, 1992

[51] Int. Cl.[5] ..... G08B 11/04

[52] U.S. Cl. ..... 340/539; 340/531; 340/502; 379/40; 379/49; 455/7; 455/13.1; 455/33.1

[58] Field of Search ..... 340/539, 531, 502; 455/7, 9, 11.1, 13.1, 33.1; 379/37-42, 43, 44, 49, 51

[56] References Cited

U.S. PATENT DOCUMENTS

| | | | |
|---|---|---|---|
| 3,560,657 | 2/1971 | Stone . | |
| 3,925,763 | 12/1975 | Wadhwani et al. | 340/539 |
| 4,219,698 | 8/1980 | Birilli et al. . | |
| 4,652,859 | 3/1987 | Van Wienen | 340/502 |
| 4,692,742 | 9/1987 | Raizen et al. | 340/539 |
| 4,856,047 | 8/1989 | Saunders | 379/57 |
| 4,887,291 | 12/1989 | Stillwell | 340/506 |
| 4,918,425 | 4/1990 | Greenberg et al. | 340/539 |
| 4,928,099 | 5/1990 | Drake | 340/539 |
| 4,952,928 | 8/1990 | Carroll et al. | 340/539 |
| 4,956,875 | 9/1990 | Bernard et al. | 455/228 |
| 4,993,059 | 2/1991 | Smith et al. | 379/39 |
| 5,051,741 | 9/1991 | Wesby | 340/539 |

*Primary Examiner*—Donnie L. Crosland
*Attorney, Agent, or Firm*—Lowe, Price, LeBlanc & Becker

[57] ABSTRACT

An emergency alerting system for alerting or warning large numbers of people of the occurrence or threat of an emergency using available communications media. Multiple facilities are monitored for the occurrence of multiple alarm conditions. On the occurrence of such a condition radio or telephone contact is made with a Local Emergency Planning Committee (LEPC) and the LEPC is notified of the site and nature of the alarm condition. Using a predetermined listing or data bank the LEPC selects a number corresponding to the site and condition and transmits such number to an automated controller for a radio transmitter. The transmitter may be part of an existing radio paging system. The automated controller, on the basis of the number dialed in by the LEPC, transmits an appropriate Code Assignment Plan (Cap Code) signal. The Cap Code signal is the electronic signature of a preprogrammed Cap Code chip within individual radio receivers positioned at the sites of intended alarm recipients. The Cap Codes are assigned and utilized to effect the notification of predetermined groups related to specific alarm conditions. Upon a receiver being actuated by receipt of its Cap Code an alarm is actuated to produce a sensory alarm signal such as sound or light. A detector is provided at the alarm site and upon detecting the sensory alarm acknowledges to the monitored facility the occurrence of the alarm.

27 Claims, 3 Drawing Sheets

ALERTING AND WARNING SYSTEM

TECHNICAL FIELD

This invention relates to an emergency alerting system designed to simultaneously alert or warn large numbers of people in the event of the occurrence or threat of an emergency. The system utilizes both radio transmission as well as the public telephone network.

BACKGROUND ART

In any community there is the ever present possibility of the occurrence of emergency situations which may affect all or some portion of the residents. These emergency situations may range from relatively minor and localized occurrences to major catastrophes such as nuclear emergencies, hazardous material incidents, chemical spills, prison emergencies or the like. The conventional means for dealing with such emergencies entails an alarm triggered by the nuclear plant, prison facility, government installation, etc., with this alarm being transmitted to a Local Emergency Planning Committee (LEPC) by conventional means such as an existing telephone or radio link or a plain old telephone (POT). The LEPC is a 911 emergency type facility such as a State Police or a fire house. Such facilities are existing and their operation is familiar. Exemplary of previously proposed and/or existing systems are the following:

U.S. Pat. No. 4,956,875, issued Sept. 11, 1990, to William B. Bernard et al describes an emergency radio alerting and warning system comprising an FM transmitter having multiple encoding means to permit the selection of all receivers in a given location and broadcasting to particular receivers in the selected location. The transmitter broadcasts signals with the encoded signals being followed by signals to activate audible alarms at the receivers which are appropriately encoded followed by transmission of the message over the loud speakers of the selected receivers. The receivers are receptive but inactive prior to receipt of an encoded signal specific to the receiver whereupon the receiver is fully activated to sound the audible alarm to alert persons in the vicinity followed by audibilizing of the broadcast message.

The foregoing system is apparently being offered for sale as advertised in an undated brochure titled "EAR" (not admitted to be prior art). This brochure describes an alternative to existing notification systems which rely on conventional radio, television, telephones and sirens. The system consists of single frequency FM receivers made available to users for installation in homes, offices, apartments and hotels. The receivers are activated by digital codes that are broadcast from low powered transmitters installed in emergency vehicles such as fire, police and ambulance vehicles.

U.S. Pat. No. 4,692,742, issued Sep. 8, 1987, to David T. Raizen et al, describes a security system for monitoring a plurality of locations by sensors which transmit alarm signals to a central control station by radio or telephone. Each alarm signal is encoded to identify the particular sensor location and alarm condition. The control station comprises a computer which correlates the received alarm signals with information stored in the computer memory to identify which of a plurality of satellite stations are to be notified of a particular alarm condition at a particular monitored location, what correlated information is to be transmitted to such satellite station, and whether to effect such transmission by radio or telephone. The computer actuates a radio or telephone transmitter in the control station to transmit correlated signals to the appropriate satellite stations, and may also actuate a speech synthesizer so that such signals may be transmitted as synthetic speech.

U.S. Pat. No. 4,856,047, issued Aug. 8, 1989, to James R. Saunders. The Saunders Patent describes an automated remote telemetry paging system for providing remote pager notification of changes in selected operating parameters measured at a specific site location. The selected parameters and the unacceptable changes therein are provided in the form of a plurality of the electrical status signals each representative of one of the selected parameters. The remote telemetry unit (RTU) includes a programmed microprocessor and a status signal receiving circuit for receiving and electronically isolating the received status signals. An interrogation circuit controlled by the microprocessor central processing unit (CPU) scans the digital status signals, and a discrimination circuit controlled by the CPU reads the digital status signals. The digital status signals are transmitted to appropriate pager communications equipment for display in remote paging devices. If it is determined that an unacceptable status signal deviation has occurred the system generates a digital status message identifying the remote site location and the selected parametric deviation, and then energizes a telephone interface when the digital status message is completed and dials preselected pager telephone numbers stored in the memory means through the telephone central switching equipment and pager network equipment.

U.S. Pat. No. 4,887,291, issued Dec. 12, 1989, to James T. Stillwell. This patent describes a system for automatically monitoring the status and safety of buildings and reporting the existence and kind of emergency to distant locations. The emergencies may be burglaries, fires, temperature excursions, extremely high or low flow rates, temperatures, pressures, etc. The system employs a plurality of facility monitors each receiving the input from a plurality of field detectors. Each facility monitor detects conditions at a specific location. When a detector in a facility monitor encounters an emergency event, that monitor transmits across a telephone line a signal which identifies the abnormal detector and identifies the kind of emergency event for which that detector would be activated and the magnitude of the emergency. Each facility has its own telephone line. The encoded message sent on the telephone line is received at the telephone company central office which forwards the information along a telephone line to a paging company. The information from the telephone line is received by a message processing computer which in turn encodes the information in a manner compatible with the radio transmitter. The transmitter broadcasts the information to a digital pocket pager to produce a display which indicates that the designated detector at the facility has enunciated an event which deserved immediate attention. The display also carries an alphanumeric message describing the nature and/or magnitude of the emergency event. The owner of the pager may then make an appropriate decision as to what type of response to make.

U.S. Pat. No. 4,993,059, issued Feb. 12, 1991, to James L. Smith et al. This patent shows an alarm system which includes both a land-based communication path and a wireless communication path between a protected premise and a public switched telephone network (PSTN) in order to communicate the existence of an alarm condition between the protected premise and an alarm monitoring station. The PSTN communicates with the alarm monitoring station via telephone line. A terminal alarm control panel includes a series of relays which upon receipt of an alarm signal from an alarm sensor connect a local telephone via a telephone line to a subscriber telephone line which is connected to the PSTN. Communication is thereby established between the protected premise and the PSTN via a subscriber line which is the land-based portion of the alarm system. Communication is thereby passed from the PSTN to the alarm monitoring station. The terminal alarm control panel may include automatic dialing circuits for dialing the telephone number of the alarm monitoring station via a subscriber telephone line or the telephone number may be dialed from a local telephone. The patent also shows a redundant communication path between the terminal alarm control panel and the PSTN in the event of a failure of the land-based portion of the alarm system. Thus the system includes a cellular type radio/telephone system including a cellular transceiver connected to the terminal alarm control panel. When an alarm condition exists at the detected premise the cellular transceiver transmits a radio frequency signal via an antenna to an antenna of a mobile telephone switching office (MTSO). The MTSO is interconnected to the PSTN.

U.S. Pat. No. 4,219,698, issued Aug. 26, 1980, to Joseph A. Birilli et al. This patent describes an alarm system which employs a radio frequency transmitter and a frequency compatible receiver that couples into a telephone system to ring a remote telephone and deliver a message into the receiver of the remote telephone. The emergency transmitter includes a small battery powered radio frequency transmitter. The receiver comprises a receiver/dialer unit having a continuously recycling magnetic tape transport and a coupling device for coupling the unit into a telephone lines. The magnetic tape transport contains a recording of a series of DTMF signals indicative of the number to be dialed and message to be delivered. When the emergency transmitter is activated it sends out an RF signal which is received by the receiver/dialer unit. Receipt of the signal by the receiver/dialer activates the magnetic tape transport and causes the unit to be accessed into a telephone number is dialed and the recorded message delivered.

U.S. Pat. No. 3,560,657 issued Feb. 2, 1971, to Paul L. Stone et al. This patent describes a burglar, fire or other alarm system. The actuation of the alarm closes a switch to energize a radio transmitter. The signal from the transmitter is detected by a centrally located receiver which actuates a switch. Closure of that switch causes energization of a tape deck to generate a recorded audio signal. The audio signal is effective to dial a predetermined number and upon the called phone going off-hook to deliver a prerecorded warning message. The device may dial a second number or redial the same number.

DISCLOSURE OF THE INVENTION

In accordance with the present invention there is provided an emergency alerting system designed to simultaneously alert large numbers of people in the event of the occurrence or threat of a major emergency such as a nuclear emergency, hazardous material incident, chemical spill or the like. The initial alarm may be triggered by the nuclear plant, prison facility, government installation, etc., and is transmitted to an LEPC by conventional means such as an existing telephone radio link or a telephone (POT). The system and service of the invention comprise the following:

Using a predetermined telephone number and appropriate security codes, the civil authority or LEPC activates the system of the invention which is referred to as the TeleWarn (Service Mark) service. This activation is effected via the public telephone network to redundant central offices preferably by private lines. The predetermined number is selected to correspond to the class and number of residents or users designated for notification in response to specific emergency situations The alarm initiation is protected by pre-programmed security codes as well as "triple trigger" activation to guard against false alarm. Triple trigger activation comprises activation three times in a specific sequence and is not known to be conventional.

The alarm is connected by the redundant central offices to an automated controller for a radio transmitter. The transmitter may be part of an existing radio paging system which transmits signals to set off alarms in the end users, homes or businesses. The automated controller, on the basis of the number dialed in by the LEPC, transmits the appropriate Code Assignment Plan (Cap Code) signal. The Cap Code signal comprises a seven digit number which is the electronic signature of the preprogrammed Cap Code chip within the individual CPE (Customer Provided Equipment) pager units. The alarm unit in the homes or businesses is preferably a 90–95 dB horn type similar to a smoke alarm. The unit contains its own radio receiver with a Cap Code chip which triggers the audible alarm.

The initial alarm communication between the monitoring device and LEPC is human operator conducted. The person originating the alarm at the monitoring device informs the person at the LEPC of the nature of the emergency and the identity of the group to be alerted. The groups may be and usually are preestablished as, for example, all persons, homes, businesses, etc., within a 10, 20, 30, etc., mile radius, all persons within a pre-established geographic sector, a predetermined group of prison or other establishment employees, etc. While this initial alarm is preferably transmitted via an existing radio link it is also possible to contact the LEPC via any existing or pre-established telephone link.

With this verbal information the operator at the LEPC selects the appropriate Cap Code to transmit in the signal to the redundant central offices. This may be accomplished by using the appropriate combination of numbers on a DTMF key pad. This Cap Code data is then encoded into the signal transmitted via the paging transmitter. The alarm unit Cap Code chip is actuated only if the transmitted signal is the same as the code contained within the chip of the alarm unit receiver.

Upon sounding of the alarm, the recipients, as previously instructed, immediately turn on their radio/TV Emergency Broadcast receivers to the preset stations/channels for detailed information and advice. At the same time, and as an automatic function of the sounding of the CPE alarm, an auto-dialer within each CPE alarm unit is actuated to initiate contact to the customer's monitoring device to verify receipt of the alarm.

This monitoring device may be at the monitored facility or any other preselected location. The customers will ordinarily be the operators of the nuclear plant, prison facility, government installation, etc., comprising the monitoring installation. The auto-dialed acknowledgment may be through the existing hard wired telephone network and will preferably actuate a print-out at the monitoring installation or any other preselected location. This will indicate which end users or alarm recipients have been notified and which have not. A renotification session is then initiated with respect to users which did not receive the alarm. Such renotification may be by auto-dialing from the LEPC and is preferably staggered to avoid overload of the central office equipment. The auto-dialed signals pass through the central offices and trigger a re-transmission of the radio alarm signal in order to reach those end users who did not receiving the initial alarm.

The auto-dialing acknowledgment capability incorporated in the equipment at the site of the alarm recipient is preferably integrated in the housing with the following functions:

1. Out-dial only,
2. Transmit customer phone number or other ID characters,
3. Release line if customer picks up phone,
4. Staggered out-dial, repeat dialing,
5. Modular "T" connection jack,
6. Auto-dialing initiated by audible alarm activation not simply receipt of signal,
7. Battery backup with low battery warning.

The alarm unit may be in one housing and may be wall mounted or plugged directly into an electrical outlet.

The system preferably includes two types of auxiliary alarm units. The first of these may be similar to the main unit but not include AC powering and auto-dialing. The unit may be battery powered, have the same signal receiver and Cap Code chip and audible alarm. This unit may be wall or ceiling mountable. A second auxiliary unit may be for the deaf or hearing impaired. This unit may also be in addition to the main unit with audible alarm since there may be people with hearing in the home when an alarm is activated. In addition to the audible alarm another form of signal may also be integrated, such as a strobe light or vibrating device. The alarm signal thus may act through different sensory reactions such as sound, light or vibration.

It is thus an object of the present invention to provide an improved system and service for alerting and warning large numbers of people in the event of the occurrence or threat of an emergency.

It is a further object of the invention to provide such a system for alerting and warning large numbers of people in the event of the occurrence or threat of an emergency utilizing presently available modes of communication.

It is still another object of the invention to provide an improved emergency alerting system and service which includes an acknowledgment from the site of the recipient of the alarm and a renotification to those sites which did not acknowledge.

It is yet another object of the invention to provide an emergency alerting system and service to alert and warn large numbers of people in the event of the occurrence of or threat of an emergency wherein an acknowledgment of receipt of the alarm is transmitted only in response to sensory detection of the occurrence of the alarm.

BRIEF DESCRIPTION OF DRAWINGS

The foregoing and other objects and advantages of the invention will become more apparent upon reference to the following specification, claims and figures of drawings wherein:

BEST MODE FOR CARRYING OUT THE INVENTION

Figure 1:
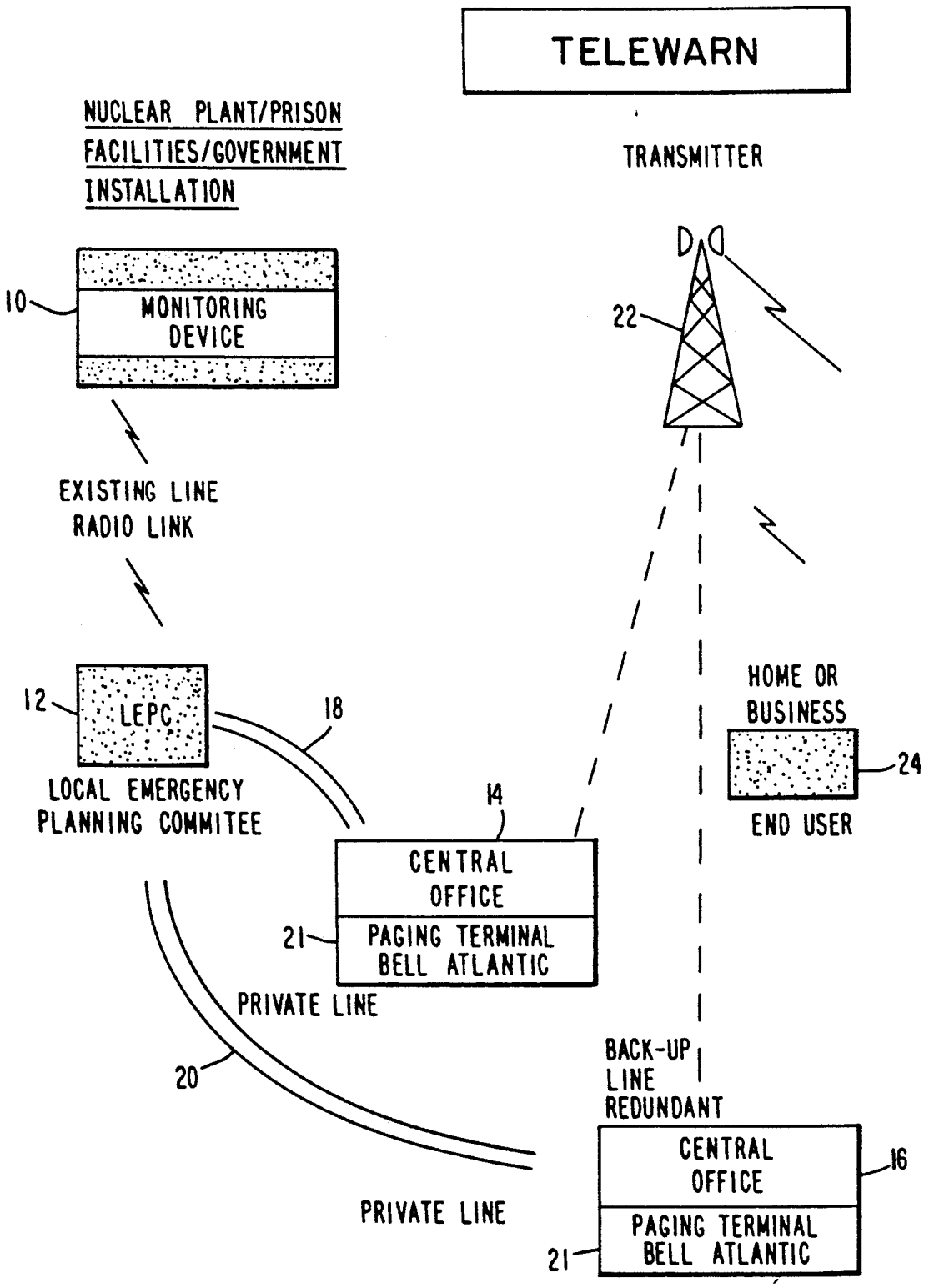
FIG. 1 is a pictorialized diagram of a system constructed according to the invention.

Referring to FIG. 1 there is shown a monitoring device 10 which is located at a facility to be monitored such as a nuclear plant, prison facility, government installation, chemical plant, or the like. The monitoring device includes conventional transducers, telemetering, alarm or the like devices of greater or lesser complexity. Such sensors may monitor varying parameters or events at a given installation which may be of technological or human origin, such as the exceeding of alarm levels in nuclear or chemical processes or the occurrence of dangerous events in prison facilities or the like.

Upon the activation of such an alarm a signal is transmitted from the monitoring device 10 to the LEPC 12 by conventional means such as an existing radio link or by the telephone network via a plain telephone. The transmission of the alarm from the monitoring device to the LEPC is commonly accomplished by an attendant or operator who not only establishes the contact but describes to the LEPC the nature of the emergency. The attendant at the LEPC 12 assigns to the described alarm condition a predetermined telephone number and appropriate security code and activates the warning service of the invention by contacting redundant central offices 14 and 16. This contact is preferably established by private lines 18 and 20 The alarm initiation is protected by the pre-programmed security codes as well as triple trigger activation to guard against false alarms. The triple trigger safeguard requires triple activation signals in a specific sequence such as 3 DTMF tones at predetermined intervals and frequencies.

The redundant central offices 14 and 16 are each associated with a paging terminal 21 for a transmitter 22 which preferably comprises an existing radio paging system. The connections between the central offices and paging terminals and/or transmitter may be hard wired, by radio, or by existing telephone network. The paging terminal 21 and transmitter 22 upon receiving the signal from the central offices (any one of which initiates the sequence) automatically transmits signals of a content which is determined by the number dialed by the LEPC. This number in turn is dependent upon the nature of the alarm condition as reported by the particular activating monitoring device and the description of the emergency situation which resulted in the assignment of that specific number.

The paging terminal contains an automated controller which, on the basis of the number dialed in by the LEPC, assigns and transmits the appropriate Code Assignment Plan (Cap Code) signal. This comprises a seven digit number which is the electronic signature or predetermined triggering code for the Cap Code chips within preselected individual CPE (Customer Provided Equipment) pager units or radio receivers located in the end user or alarm recipient sites such as homes or businesses 24. Triggering of the Cap Code in a particular receiver causes actuation of an alarm unit which may be of the 90–91 dB horn type similar to a smoke alarm.

Upon the user or alarm recipient hearing or seeing the alarm, the recipient immediately turns on his/her radio/TV Emergency Broadcast receiver to the pre-established station/channels to receive detailed information and advice. At the same time and as an automatic function of the sounding of the recipient's alarm, an auto-dialer within each alarm unit is actuated to initiate contact to the monitoring device to acknowledge or verify receipt of the alarm. This auto-dialed acknowledgment preferably occurs through the existing telephone network and preferably actuates a print-out at the monitoring device. The print-out provides a permanent record of which end users have been notified and which have not. Based upon this information a redialing session is initiated with respect to users who did not receive the alarm. Such a redialing session is preferably staggered or sequential rather than simultaneous in order to avoid overload of the affected central office equipment. The redialed signals pass through the central offices 14 and 16 and trigger a retransmission of the radio alarm signal in order to reach those end users who did not receive the initial alarm.

Figure 2:
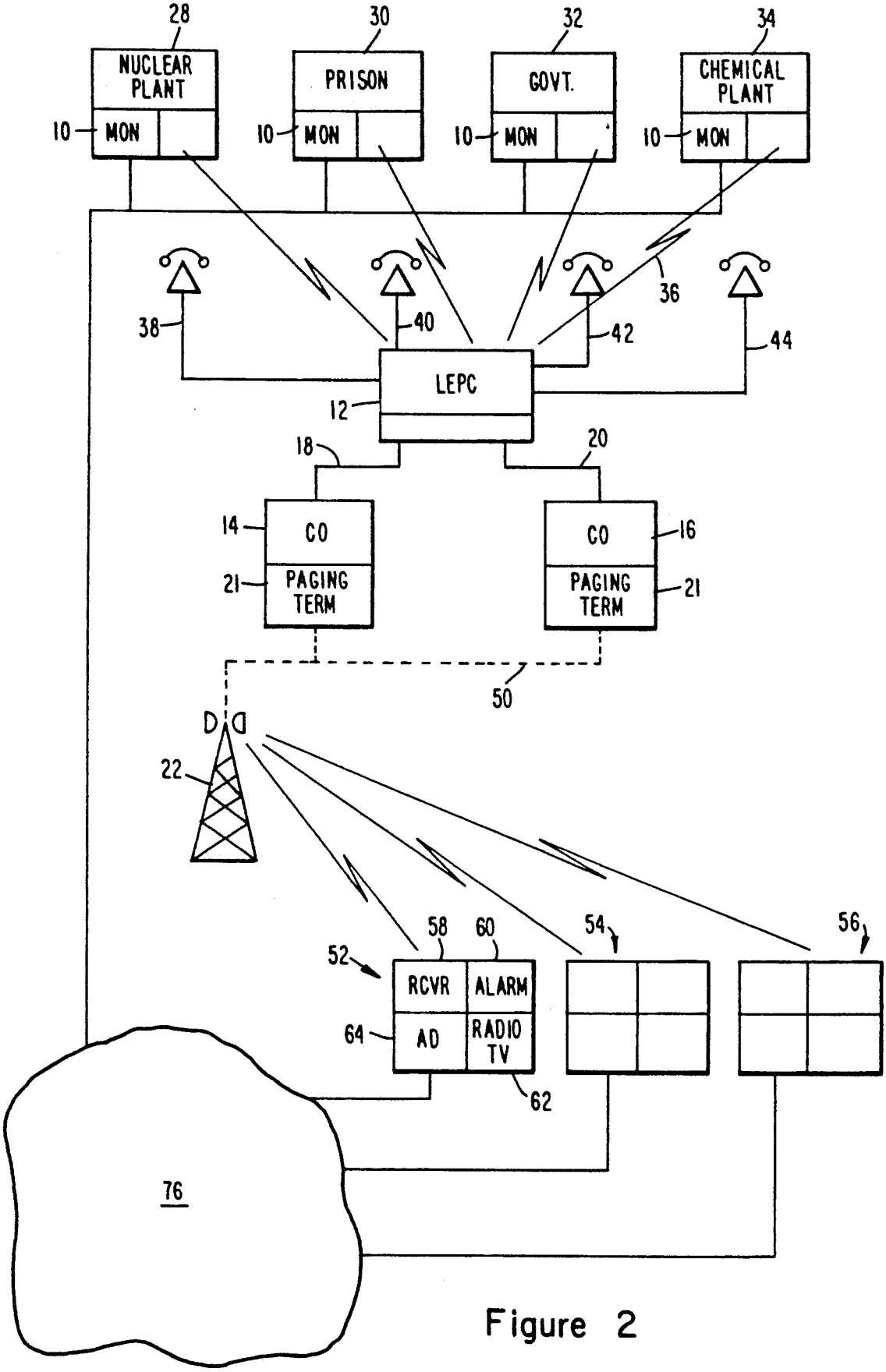
FIG. 2 is a diagrammatic representation of a system constructed according to the invention.

Referring to FIG. 2 there is shown a more detailed illustration of the system of the invention. Thus there appear in that figure a series of customer installations such as a nuclear plant 28, prison facility 30, government installation 32, chemical plant 34 and other additional customer users (not shown). Each user facility contains a monitoring device 10 which monitors the particular parameters selected for monitoring according to the purpose, function and operation of each facility. Thus, the nuclear plant would include multiple transducing devices for monitoring various aspects of the operation of that plant. The prison facility has multiple alarms indicating emergencies in various portions of the facility. The government installation and chemical plant similarly provide alarm or transducer signals peculiar to the function of that installation.

A Local Emergency Planning Committee (LEPC) 12 is connected to the facilities 28–34 through a conventional telephone/radio link indicated generally at 36 and/or by a dedicated telephone line indicated at 38–44. The telephone links 38–44 need not be dedicated but may comprise a plain telephone network link.

The LEPC is conventionally provided with multiple operators who ascertain the nature of an incoming emergency call and respond accordingly to the police, fire department, ambulance service or the specific emergency being reported. According to the invention the LEPC operator responds to the calling monitored facility and particularly to the emergency being reported by the monitoring station in the activating facility 28–34. Upon learning the nature of the emergency, such as, for example, a malfunction at a nuclear plant, the operator refers to a database, computerized or manual, and ascertains the proper security code and directory or other number assigned to the specific emergency situation. The operator thereupon actuates the predetermined security code preferably in a triple trigger actuation. That is, the security code is entered three times at predetermined time intervals. Any other predetermined number of actuation entries may be required to provide the degree of security desired. The operator thereupon dials the number determined from the database for the specific emergency involved.

This dialing occurs across private lines 18 and 20 connecting the LEPC to redundant central offices 14 and 16. Associated with each central office 14 and 16 is a paging terminal 21 which controls a radio transmitter 22 via hard wired, radio or existing telephone network links generally indicated at 50. As previously stated, the paging terminal contains an automated controller which on the basis of the number dialed in by the LEPC, assigns and causes the transmitter to transmit the appropriate Cap Code signal. This comprises a 7 digit number which is the electronic signature or predetermined triggering code for the Cap Code chips within those preselected individual CPE devices or receivers in individual end user establishments such as shown at 52, 54, 56. Each such device includes a radio receiver 58, alarm 60, radio/TV unit 62 and automatic dialer 64.

The radio receiver 58 is individualized to the specific end user or alarm recipient involved and provided with a Cap Code chip containing a code specific to that end user. When that receiver detects receipt of its assigned Cap Code the receiver delivers to the alarm 60 an activating signal causing actuation of the alarm unit. As stated this may be of the 90–95 dB horn type alarms similar to those utilized in conventional home smoke alarms. Alternatively or in addition it may comprise a light or vibrating signal.

Figure 3:
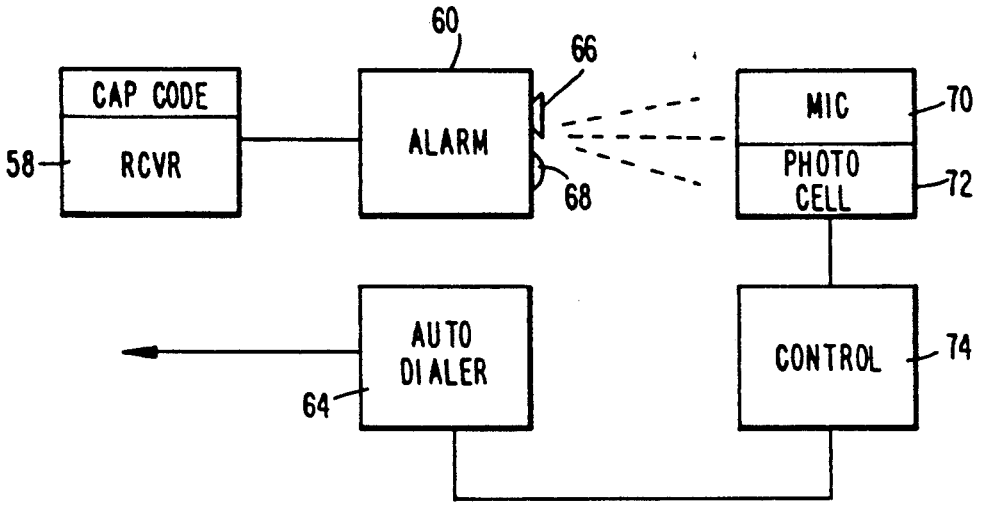
FIG. 3 is a more detailed representation of the equipment at the site of the user or individual to be notified or alarmed.

Referring to FIG. 3, there is shown additional detail of the installation in the end user or alarm recipient premises. Thus the alarm 60 may be provided with not only a noise generating device 66 but also a light generating device 68 which may be utilized to transmit the alarm to the handicapped such as deaf or hard of hearing persons. Microphone and photocell units 70 and 72 are provided within the alarm housing or adjacent thereto to detect the sound or light alarm or both. Detection of one or both alarms, as the case may be, provides a trigger signal to a control device 74 which actuates an auto-dialer 64 to dial a predetermined number to initiate contact to the monitoring device 10 in the facility which initiated the alarm. This auto-dialing signal is transmitted via the public telephone network indicated generally at 76 in FIG. 2 linked to the auto-dialers 64 and monitors 10. The auto-dialed signal transmitted to the monitor contains the identity of the auto-dialing station as by Caller ID or ANI or other means.

According to the invention the auto-dialer provides out-dial only and automatically releases the line if the end user picks up the telephone in the end user facility. This feature prevents auto-dialer interference with potential emergency calls from the site of the end user. The auto-dialer may include the auto-dialing identification information as a safeguard against the absence or unavailability of ANI or Caller ID or equivalent facility. The auto-dialer and its control also preferably include a timing and redial feature so that the auto-dialing from the respective actuated receivers and alarm and control devices occurs in staggered sequence to prevent blocking of the monitoring station receipt of the redialed acknowledgment. If the monitor does return to the auto-dialer a busy signal the redial feature provides for redialing until acknowledgment is accomplished. The receiver, alarm, detectors, control and auto-dialer are preferably provided with battery back-up and a low battery warning device such as is common in smoke alarms.

Figure 4:
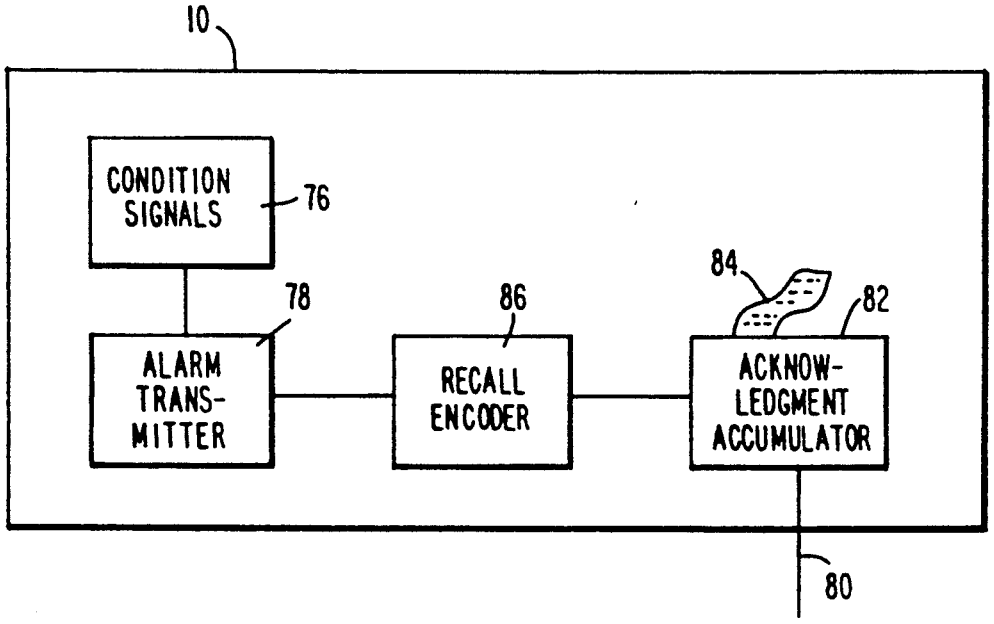
FIG. 4 is a more detailed representation of the equipment at a monitored facility.

Referring to FIG. 4 there is shown a detailed diagram of a monitoring device constructed to an embodiment of the invention. Referring to that figure, the transducers or alarm indicators at the monitored installation provide audible or display alarm signals or condition signals via an alarm indicator. As previously discussed these are transmitted through an operator or attendant contacting the LEPC on an alarm transmitter 78 which may comprise a radio or telephone link. Acknowledgments from the auto-dialer 64 (FIG. 3) are received on the telephone network link 80 as described in connection with FIG. 2. These acknowledgment signals are accumulated in an acknowledgment accumulator 82 which may print out a written list 84 of stations which have received the alarm. The acknowledgment accumulator also transmits to a recall encoder 86 an electronic signal equivalent of the list 84. The recall encoder 86 compiles from that list and a suitable self-contained memory an encoded list of stations which have not been notified. This encoded signal is then transmitted via the alarm transmitter 78 to the LEPC.

The LEPC thereupon transmits this signal to the central offices and paging terminals for transmittal as appropriate Cap Code numbers a signal to effect a second actuation of the alarm 60 in those end user stations which did not acknowledge receipt of the first alarm. This sequence is repeated until all stations have acknowledged receipt of the alarm. While this transmittal of the non-acknowledging station list has been described as automated in connection with FIG. 4 it will be understood that the invention contemplates the compiling of the non-acknowledging information manually from the list 84 and manual utilization of the alarm transmitter device 78 by the operator to transmit the necessary information to the end user's receivers. Alternatively it will be appreciated that the original alarm sequence wherein an operator contacts the LEPC may be automated by replacing the operator with an electronic translator which translates the information from the condition signals 76 into a synthesized voice message transmitted to the LEPC following auto-dialing by the alarm transmitter 78.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. An alerting and warning system for directing an alarm signal to a selectable class and number of radio receivers comprising:

at least one facility to be monitored for the occurrence of an alarm condition;

means for transmitting a notification signal indicating the occurrence of an alarm condition at a monitored facility;

annunciators located at sites to be alerted to alarm conditions;

radio receiving means associated with said annunciation means and responsive to signals of a predetermined code from said means for transmitting to actuate their associated annunciators;

dispatching means responsive to said notification signal indicating the occurrence of an alarm condition at a monitored facility for transmitting a first signal indicative of a class of receivers to be contacted;

means for encoding and transmitting radio signals in response to said first signal, said radio signals being encoded to cause the receivers in the class indicated by the first signal to respond and actuate their associated annunciators; and means for auto dialing at said sites to be alerted, said means for auto dialing being responsive to actuation of said annunciators to send an acknowledgement signal.

2. An alerting and warning system according to claim 1 wherein said dispatching means transmits said first signal via redundant telecommunication.

3. An alerting and warning system according to claim 2 wherein said redundant telecommunication is transmitted to multiple switching nodes.

4. An alerting and warning system according to claim 3 wherein said means for encoding and transmitting is responsive to signals received from one of said switching nodes.

5. An alerting and warning system according to claim 1 wherein said dispatching means comprises a public emergency center which receives notification of the occurrence of an alarm condition from said means for transmitting a notification of the occurrence of an alarm condition at a monitored facility.

6. An alerting and warning system according to claim 1 wherein said annunciators emit sensible signals to indicate an alarm condition and said means for auto dialing responds to detection of said sensible signals.

7. An alerting and warning system according to claim 6 including means for receiving said acknowledgment signals and transmitting a repeat notification to those receiving means which failed to acknowledge receipt of said first signal.

8. An alerting and warning system according to claim 1 wherein said facility to be monitored includes multiple types of alarm conditions;

said means for transmitting a notification of the occurrence of an alarm condition transmitting a signal indicative of the identity of the alarm condition which has occurred;

said dispatching means determining the class or number of receivers to be contacted on the basis of the identification of said alarm condition.

9. An alerting and warning system according to claim 1 including:

multiple facilities to be monitored for the occurrence of multiple alarm conditions;

said means for transmitting, transmitting the identification of the facility and the identity of the alarm condition at said facility which has occurred;

said dispatching means responsive to notification of said alarm condition transmitting a first signal indicative of the class and number of receivers to be contacted;

said means for encoding and transmitting radio signals in response to said first signals encoding said signals to cause receivers in the class and number indicated by said first signal to respond and actuate their associated annunciator.

10. An alerting and warning system for directing an alarm signal to a selectable class and number of radio receivers comprising:

at least one facility to be monitored for the occurrence of an alarm condition;

means for transmitting a notification signal indicating the occurrence of an alarm condition at a monitored facility;

annunciators located at sites to be alerted to alarm conditions;

radio receiving means associated with said annunciators and responsive to signals of a predetermined code from said means for transmitting to actuate their associated annunciators;

dispatching means responsive to said notification signal indicating the occurrence of an alarm condition at a monitored facility for transmitting a first signal indicative of a class of receivers to be contacted;

means for encoding and transmitting radio signals in response to said first signal, said radio signals being encoded to cause the receivers in the class indicated by said first signal to respond and actuate their associated annunciators; and means for auto dialing at said sites to be alerted, said means for auto dialing being responsive to actuation of said annunciators to send an acknowledgement signal;

means for receiving said acknowledgement signal and controlling transmission of a repeat notification to those receiving means which failed to acknowledge receipt of said first signal.

11. An alerting and warning system according to claim 10 wherein said dispatching means transmits said first signal via redundant telecommunication.

12. An alerting and warning system according to claim 11 wherein said redundant telecommunication is transmitted to multiple switching nodes.

13. An alerting and warning system according to claim 12 wherein said means for encoding and transmitting is responsive to signals received from one of said switching nodes.

14. An alerting and warning system according to claim 10 wherein said dispatching means comprises a public emergency center which receives notification of the occurrence of an alarm condition from said means for transmitting a notification of the occurrence of an alarm condition at a monitored facility.

15. An alerting an warning system according to claim 10 wherein said annunciators emit sensible signals to indicate an alarm condition and said means for auto dialing.

16. An alerting and warning system according to claim 15 including means for receiving said acknowledgment signals and transmitting a repeat notification to those receiving means which failed to acknowledge receipt of said first signal.

17. An alerting and warning system according to claim 10 wherein said facility to be monitored includes multiple types of alarm conditions;

said means for transmitting a notification of the occurrence of an alarm condition transmitting a signal indicative of the identity of the alarm condition which has occurred;

said dispatching means determining the class or number of receivers to be contacted on the basis of the identification of said alarm condition.

18. An alerting and warning system according to claim 10 including:

multiple facilities to be monitored for the occurrence of multiple alarm conditions;

said means for transmitting, transmitting the identification of the facility and the identity of the alarm condition at said facility which has occurred;

said dispatching means responsive to notification of said alarm condition transmitting a first signal indicative of the class and number of receivers to be contacted;

said means for encoding and transmitting radio signals in response to said first signals encoding said signals to cause receivers in the class and number indicated by said first signal to respond and actuate their associated annunciators.

19. A method of actuating alarm signals to alert a selectable class and number of radio receivers comprising the steps of:

monitoring at least one facility to detect the occurrence of an alarm condition;

transmitting a notification signal indicating the occurrence of an alarm condition at said monitored facility to a dispatching center;

encoding information derived from said notification dependent upon characteristics of the occurrence to predetermine a class of potential alarm recipients to be alerted;

transmitting radio signals containing said encoded information to cause similarly coded radio receivers at sites of said recipients to respond and actuate annunciators at said sites; and detecting at said sites the actuation of said annunciator and performing an auto dial function in response to said actuation to send an acknowledgement signal indication of said actuation.

20. A method of actuating alarm signals to alert a selectable class and number of radio receivers comprising the steps of:

monitoring multiple facilities to detect the occurrence of an alarm condition;

identifying the nature of an alarm condition occurring at one of said facilities;

transmitting a notification signal indicating the occurrence of said alarm condition at said facility to a dispatching center;

encoding information derived from said notification dependent upon the identity of the facility and the nature of the alarm condition to predetermine the class and number of potential alarm recipients to be alerted;

transmitting radio signals containing said encoded information to cause similarly coded radio receivers at sites of said recipients to respond and actuate annunciators at said sites; and detecting at said sites the actuation of said annunciation means and performing an auto dial function in response to said actuation to send an acknowledgment of said actuation.

21. A method of actuating alarm signals according to claim 20 including the step of said annunciators generating sensible alarm signals.

22. A method of actuating alarm signals according to claim 21 including the step of reacting to said sensory alarm signal to send the acknowledgement signal.

23. A method of actuating alarm signals according to claim 20 including the step of transmitting radio signals responsive to said acknowledgment and encoding said radio signals to cause response by those receivers which failed to acknowledge the radio signals containing said encoded information.

24. A method of actuating alarm signals according to claim 23 wherein said radio signals are transmitted to said radio receivers in staggered fashion.

25. A method of actuating alarm signals according to claim 20 including the step of transmitting from said dispatching center a coded signal corresponding to the identity of the facility and the nature of the alarm condition;

said encoding step being based upon the content of said coded signal.

26. A method of actuating alarm signals according to claim 25 including the step of transmitting said coded signal via a telephone link.

27. A method of actuating alarm signals according to claim 25 including the step of transmitting said coded signal via a radio link.

* * * * *